US007134712B2

(12) United States Patent
Piretti

(10) Patent No.: US 7,134,712 B2
(45) Date of Patent: Nov. 14, 2006

(54) CHAISE-LONGUE

(75) Inventor: Giancarlo Piretti, Bologna (IT)

(73) Assignee: Pro-Cord Spa, Bologna (IT)

( * ) Notice: Subject to any disclaimer, the term of this patent is extended or adjusted under 35 U.S.C. 154(b) by 19 days.

(21) Appl. No.: 10/891,409

(22) Filed: Jul. 14, 2004

(65) Prior Publication Data

US 2005/0206203 A1 Sep. 22, 2005

(30) Foreign Application Priority Data

Jul. 14, 2003 (EP) ..... 03425462

(51) Int. Cl.
*A47C 4/00* (2006.01)
*B60N 2/02* (2006.01)
*A47B 7/02* (2006.01)

(52) U.S. Cl. ..... 297/29; 297/68; 297/321; 297/411.34; 5/618

(58) Field of Classification Search ..... 297/16.1, 297/29, 34, 68, 32, 321, 322, 411.34; 5/618
See application file for complete search history.

(56) References Cited

U.S. PATENT DOCUMENTS 202,936 A * 4/1878 Rieder ..... 5/618
1,261,040 A * 4/1918 Lanes ..... 297/68
2,289,031 A * 7/1942 Moeller ..... 297/18
3,051,965 A * 9/1962 Szemplak et al. ..... 5/616
3,127,783 A 4/1964 Martens ..... 74/424.8
3,138,805 A * 6/1964 Piazza ..... 5/618
3,306,659 A * 2/1967 Greiner ..... 297/19
3,319,270 A * 5/1967 Greiner ..... 5/617
3,665,528 A * 5/1972 Kjellberg et al. ..... 5/618
4,186,456 A * 2/1980 Huempfner ..... 5/428
5,902,220 A 5/1999 Lin ..... 482/142
6,640,365 B1 * 11/2003 Chang ..... 5/618

FOREIGN PATENT DOCUMENTS

CH 680 767 A5 11/1992
EP 1 040 777 A1 10/2000

* cited by examiner

*Primary Examiner*—Peter M. Cuomo
*Assistant Examiner*—Sarah B. McPartlin
(74) *Attorney, Agent, or Firm*—Seed IP Law Group PLLC

(57) ABSTRACT

The disclosure generally describes a chaise longue having a base structure that supports a backrest section, a footrest section and an intermediate section. The intermediate section is connected between the backrest section and the footrest section. The base structure can include a first movable support that supports the backrest section and can articulate about a first stationary transverse axis. The base structure can also include a second movable support that supports the footrest section and can articulate about a second stationary transverse axis.

14 Claims, 9 Drawing Sheets

CHAISE-LONGUE

BACKGROUND OF THE INVENTION

1. Field of the Invention

The present invention relates to a chaise-longue recliner.

2. Description of the Related Art

A chaise-longue is a reclining chair with anatomical shape which allows the user to assume a semi-reclined resting position. A chaise-longue is traditionally formed by three sections with different inclination: a backrest section, an intermediate section and a footrest section. When the user sits on a chaise-longue, his/her knees are usually at a greater height than his/her hips and feet.

The chaise-longue with continuous adjustment designed by Le Corbusier in 1927 is a furnishing element that has become a part of the design history. The chaise-longue with continuous adjustment is formed by a structure bearing down on the ground, which bears a seating structure that includes two arched support elements able to slide relative to the stationary base structure, so that the user can vary the inclination of the seating structure at will.

BRIEF SUMMARY OF THE INVENTION

One object of the present invention is to provide a chaise-longue. In one embodiment, the chaise-longue has a structure in which the various parts can be varied, for example the relative position between a backrest section and an intermediate section or the relative position between an intermediate section and a footrest section.

In one aspect a chaise-longue is provided. In one embodiment, the chaise-longue has a base structure bearing a backrest section, a footrest section and an intermediate section. The intermediate section is connected between the backrest section and the footrest section. The base structure of the chaise-longue can include a first movable support bearing the backrest section, where the first movable support is articulatable about a first stationary transverse axis. The chaise-longue can further include a second movable support bearing the footrest section where the second movable support is articulatable about a second stationary transverse axis.

BRIEF DESCRIPTION OF THE SEVERAL VIEWS OF THE DRAWINGS

The present invention shall now be described in detail with reference to the accompanying drawings, provided purely by way of non-limiting example, in which.

DETAILED DESCRIPTION OF THE INVENTION

Figure 1:
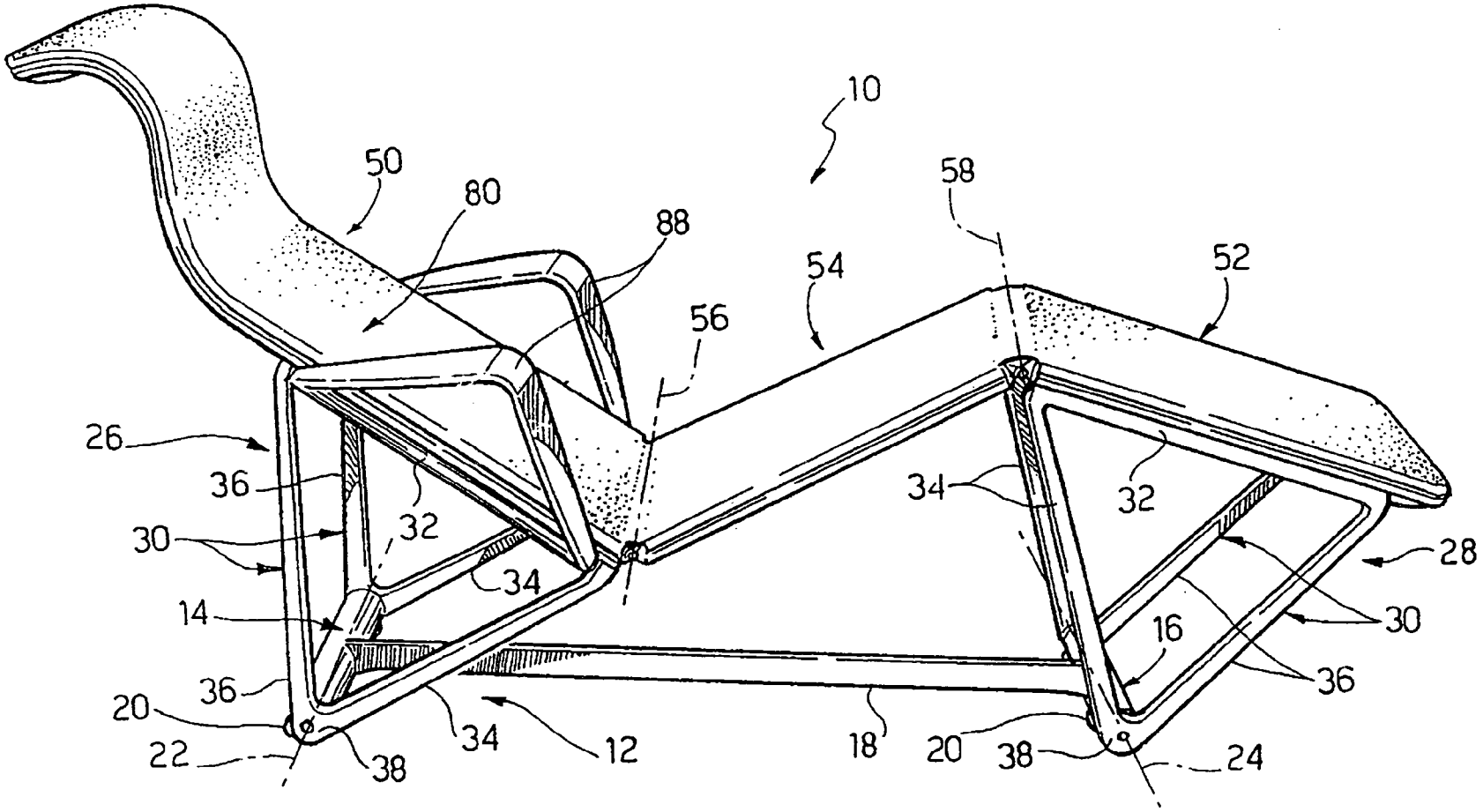
FIGS. 1 and 2 are perspective views showing a chaise-longue according to the present invention in two operative positions.

With reference to FIGS. 1 through 5, a chaise-longue 10 according to one illustrated embodiment of the present invention includes a stationary base structure 12. The stationary base structure 12 comprises a first transverse base element 14 and a second transverse base element 16. The two transverse base elements 14, 16 are mutually fastened by means of a longitudinal structure which, in the illustrated example, is formed by a single longitudinal element 18 fastened at its ends to the transverse elements 14, 16. The longitudinal structure that connects the transverse elements 14, 16 to each other may be subject to numerous variations. For instance, the central longitudinal element 18 could be replaced by two or more longitudinal elements in lateral positions. One purpose of the longitudinal structure 18 is to maintain in fixed position the two transverse base elements 14, 16. The stationary base 12 is provided with elements for contacting the ground 20, for instance provided on the lower surfaces of the transverse base elements 14, 16. The two transverse base elements 14, 16 respectively bear transverse articulation axes 22, 24 parallel to each other.

The chaise-longue 10 comprises two movable supports 26, 28 articulated to the stationary base 12 about the respective transverse articulation axes 22, 24. Each movable support 26, 28 comprises two support elements 30 with triangular shape. The two support elements 30 of each movable support 26 are articulated to a respective transverse element 14, 16 about the transverse axis 22, 24. The support elements 30 with triangular shape are positioned at the opposite ends of the respective transverse base elements 14, 16. Each triangular support element 30 has an upper side 32, an inner side 34 and an outer side 36. The vertex 38 formed by the sides 34 and 36 is articulated to an end of the respective transverse base element 14, 16.

Figure 7:
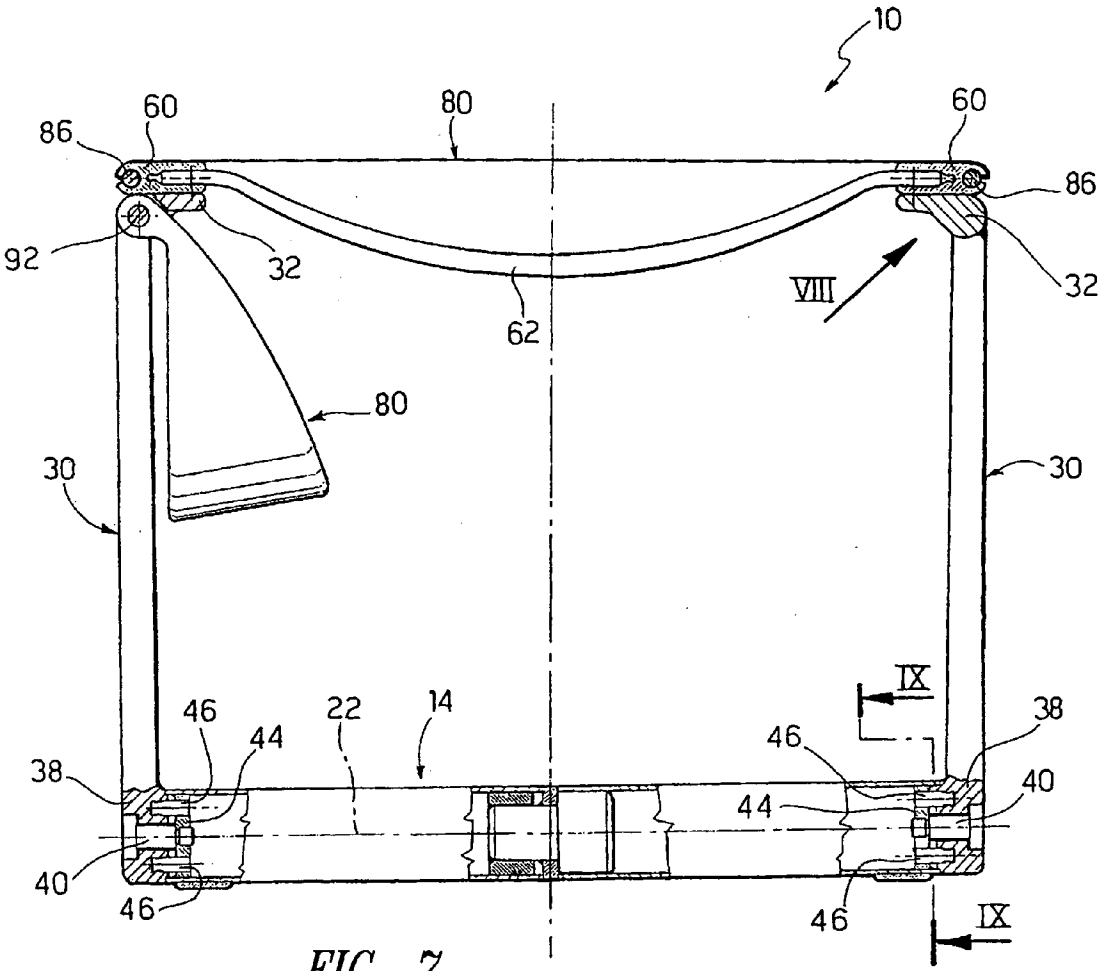
FIG. 7 is a section according to the line VII—VII of FIG. 6.
Figure 8:
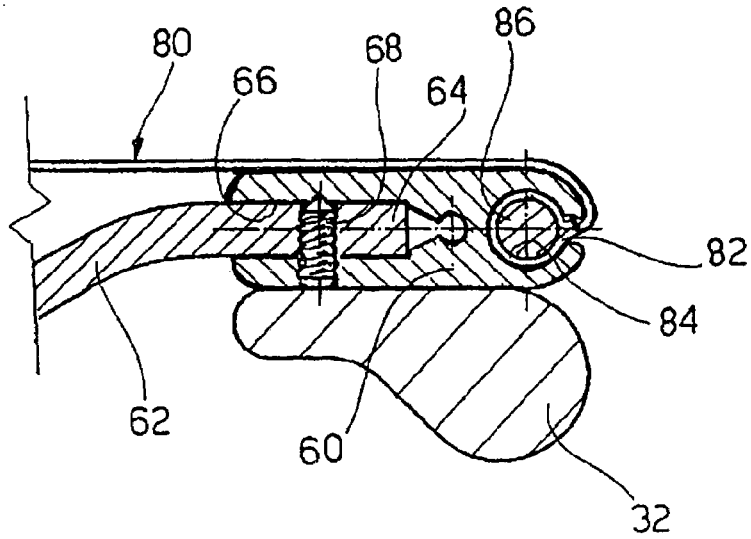
FIG. 8 is a detail in enlarged scale of the part indicated by the arrow VIII in FIG. 7.
Figure 9:
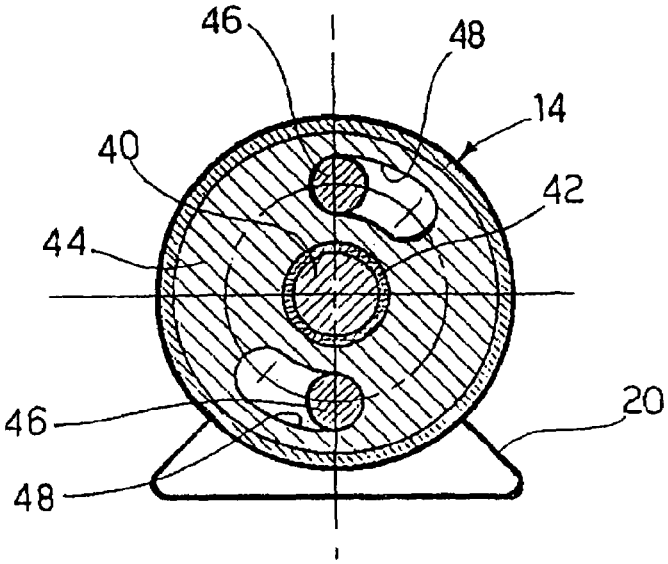
FIG. 9 is a section according to the line IX—IX of FIG. 7.

With reference to FIGS. 7 and 9, the vertex 38 of each triangular support element 30 is articulated to the transverse base element 14 by means of a pivot pin 40 preferably provided with a coaxial bushing 42 (FIG. 9). The pivot pin 40 is fastened to a disk 44 fastened to the end of the transverse base element 14 or 16. The vertex 38 of each triangular support element 30 is free to rotate about the axis of the respective pivot pin 40 which defines the axis of articulation 22 or 24. End stop means are provided, positioned between each triangular support element 30 and the respective end of the transverse base element 14, 16. In the embodiment illustrated in FIGS. 7 and 8, the end stop means comprise a pair of pivot pins 46 positioned diametrically opposite to the axis of articulation 22 or 24. The pivot pins 46 are fastened to the vertex 38 of the triangular support element 30 and engage in freely sliding fashion respective arched grooves 48 formed in the disk 44 fastened to the transverse support element 14 or 16. The length of the arched grooves 48 determines the amplitude of the oscillation motion of the triangular support elements 30.

The chaise-longue 10 is provided with a backrest section 50, a footrest section 52 and an intermediate section 54 connected between the backrest section 50 and the footrest section 52. The intermediate section 54 is articulated to the backrest section 50 about a transverse axis 56 and it is articulated to the footrest section 52 about a transverse axis 58 parallel to the transverse axis 56. The axes 56, 58 are parallel to the axes of articulation 22, 24. The first movable support 26 is fastened to the backrest section 50 and the second movable support 28 is fastened to the footrest section 52.

Each section 50, 52, 54 comprises two lateral longitudinal elements 60 mutually connected by two cross members 62, preferably with an arched shaped with the concavity oriented upwards. As shown in FIGS. 7 and 8, the end of each cross member 62 is fastened to the respective lateral longitudinal elements 60. Said fastening can be effected as shown in FIG. 8, with the insertion of each end portion 64 of each cross member 62 into a cavity 66 of the corresponding lateral longitudinal element 60. A screw 68 completes the fastening of the end portion 64 relative to the lateral longitudinal element 60.

The lateral longitudinal elements 60 of the backrest section 50 are fastened to the respective upper sides 32 of the first movable support 26.

The two lateral longitudinal elements 60 of the backrest section 50 are fastened to the respective upper sides 32 of the first movable support 26. The lateral longitudinal elements 60 of the footrest section 52 are fastened to the upper sides 32 of the second movable support 28. Said fastening can be effected in any way, for instance by means of screws, welding, fixed joint, etc.

Figure 11:
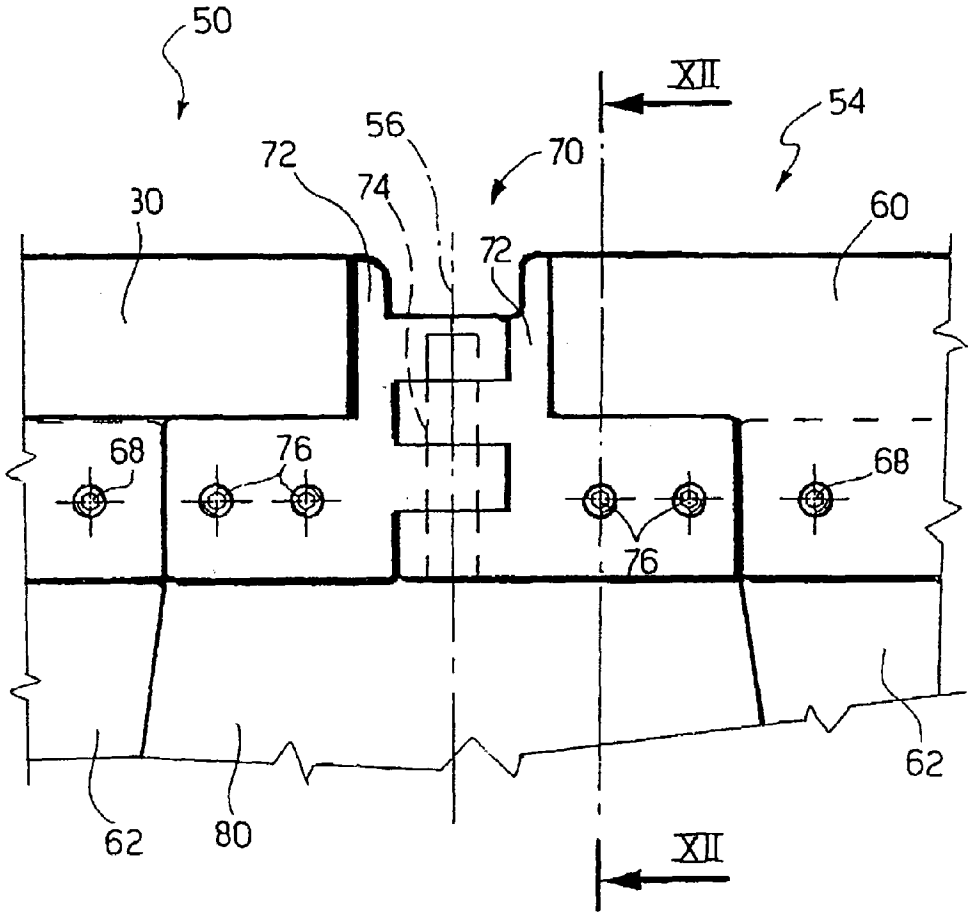
FIG. 11 is an enlarged scale view of the detail indicated by the arrow XI in FIG. 6.

The articulation of the intermediate section 54 to the backrest section 50 and to the footrest section 52 can be effected as shown in FIG. 11. The lateral longitudinal elements 60 of two adjacent sections 50, 54 (or 54, 52) are mutually articulated by means of a hinge 70 including two hinge elements 72 mutually articulated by means of a hinge pin 74.

Figure 12:
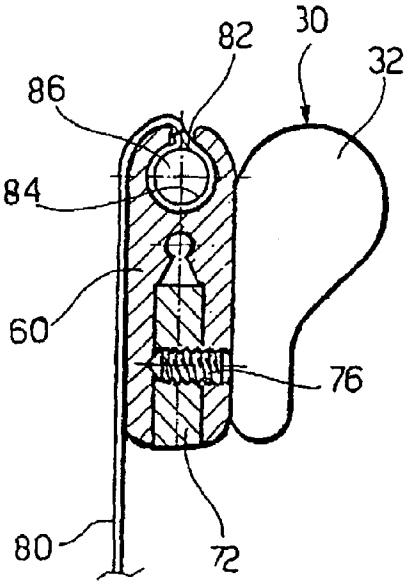
FIG. 12 is a section according to the line XII—XII of FIG. 11.

The lateral longitudinal elements 60 of the three sections 50, 52, 54 bear a support element having the task of supporting the weight of the occupant and forming the bearing surface of the three sections 50, 52, 54. The support element can be made of rigid, semi-rigid, flexible or padded material. In the illustrated embodiment, the support element is formed by a fabric sheet 80 fastened along its longitudinal edges to the lateral longitudinal elements 60. As shown in particular in FIGS. 8 and 12, each longitudinal edge of the fabric 80 forms an eyelet 82 which is inserted in a longitudinal seat 84 in the respective lateral longitudinal element 60. The eyelet 82 is fixed in the seat 84 by means of a longitudinal rod 86. According to one embodiment of the present invention, a single monolithic layer 80 extends along the three sections 50, 52 and 54. The fabric 80 extends continuously along the entire upper surface of the sections 50, 52 and 54.

The chaise-longue can be provided with a pair of armrests 88. Each armrest 88 is preferably movable between an operative position and an inoperative position, and vice versa.

Figure 10:
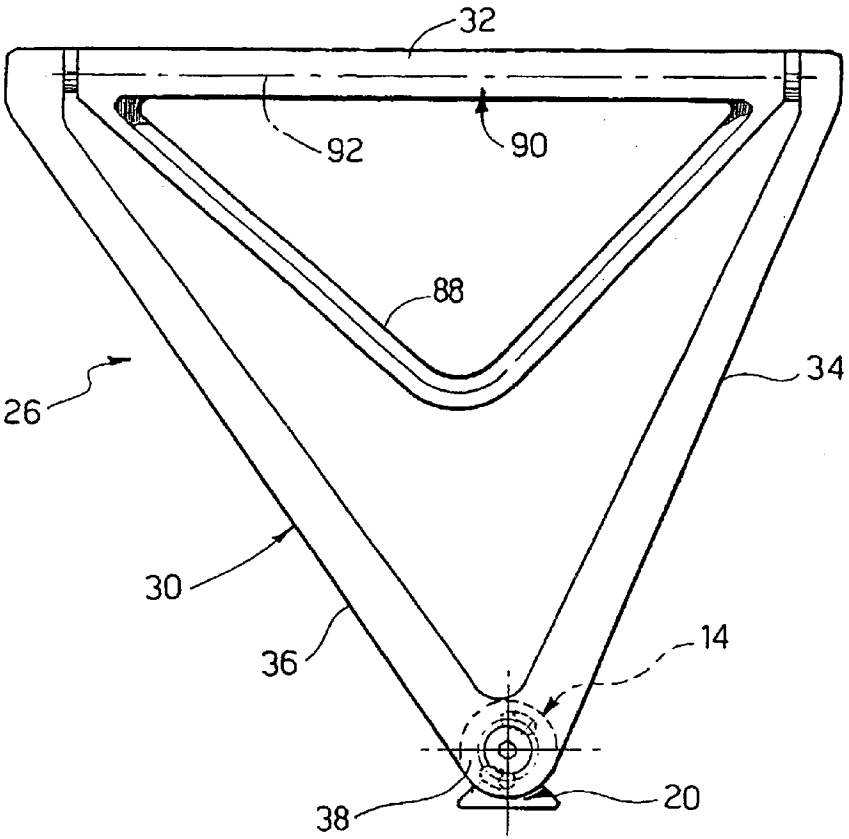
FIG. 10 is side elevation view of the armrest.

In the illustrated embodiment, each armrest 88 is borne by a respective triangular support element 30. With reference in particular to FIG. 10, each armrest 88 preferably has triangular shape and is positioned with its side 90 parallel to the upper side 32 of the support element 30. Each armrest 88 is articulated to the support element 30 about a longitudinal axis 92 and is movable between the lowered position shown in FIGS. 3, 5 and 10 and the raised position shown in FIGS. 1, 2 and 4. Retaining means (not shown herein) are provided to hold each armrest 88 in the raised position and in the lowered position. Preferably, said retaining means are engaged in snap-on fashion under the action of an elastic element, so that the user can move the armrest from the raised position to the lowered position and vice versa by applying a sufficient torque about the axis of rotation of the armrest to overcome the resistance of the spring retaining element.

Figure 2:
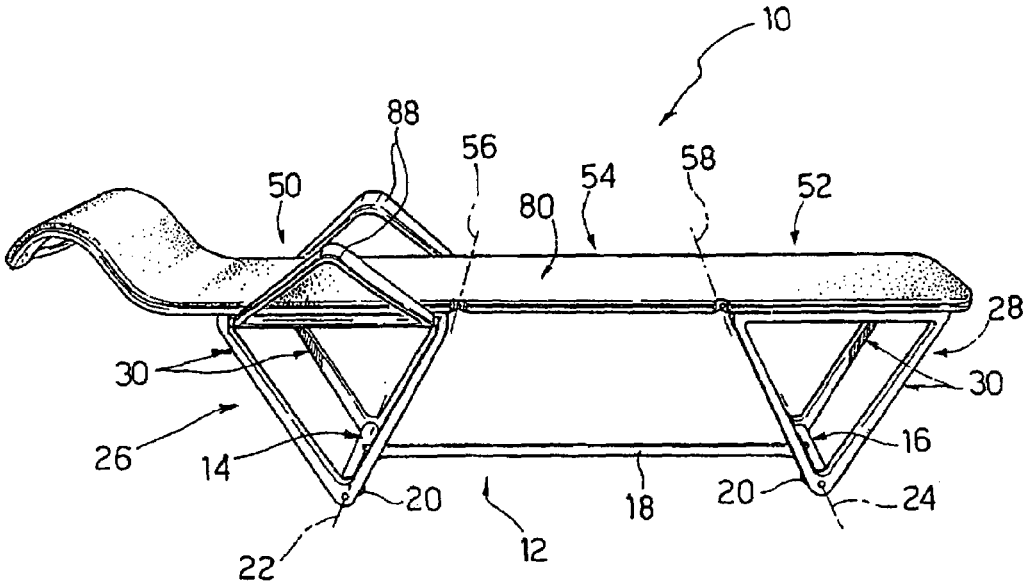
Figure 3:
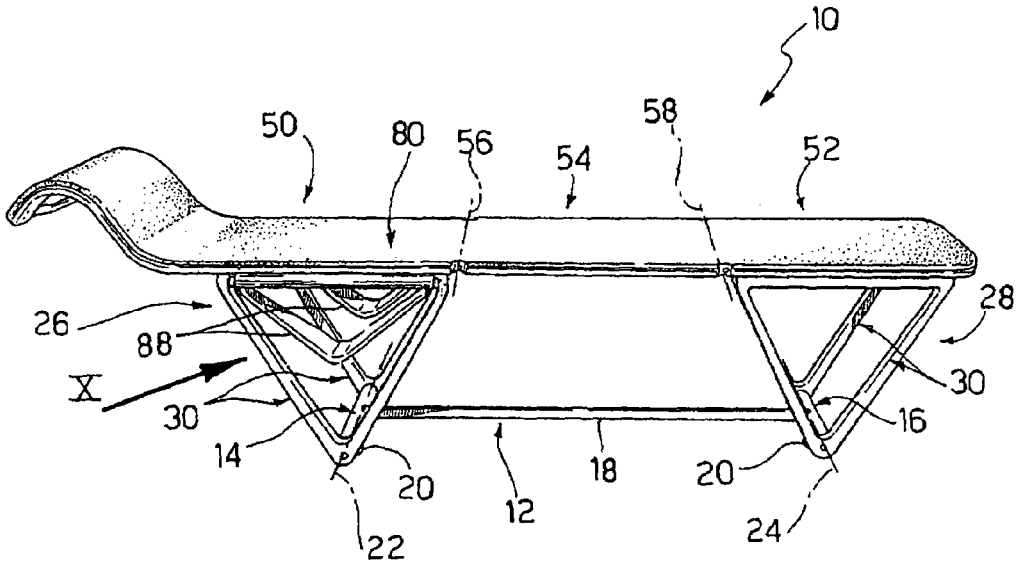
FIG. 3 is a perspective view showing the chaise-longue in the operative position of FIG. 2 and with the armrests lowered.
Figure 4:
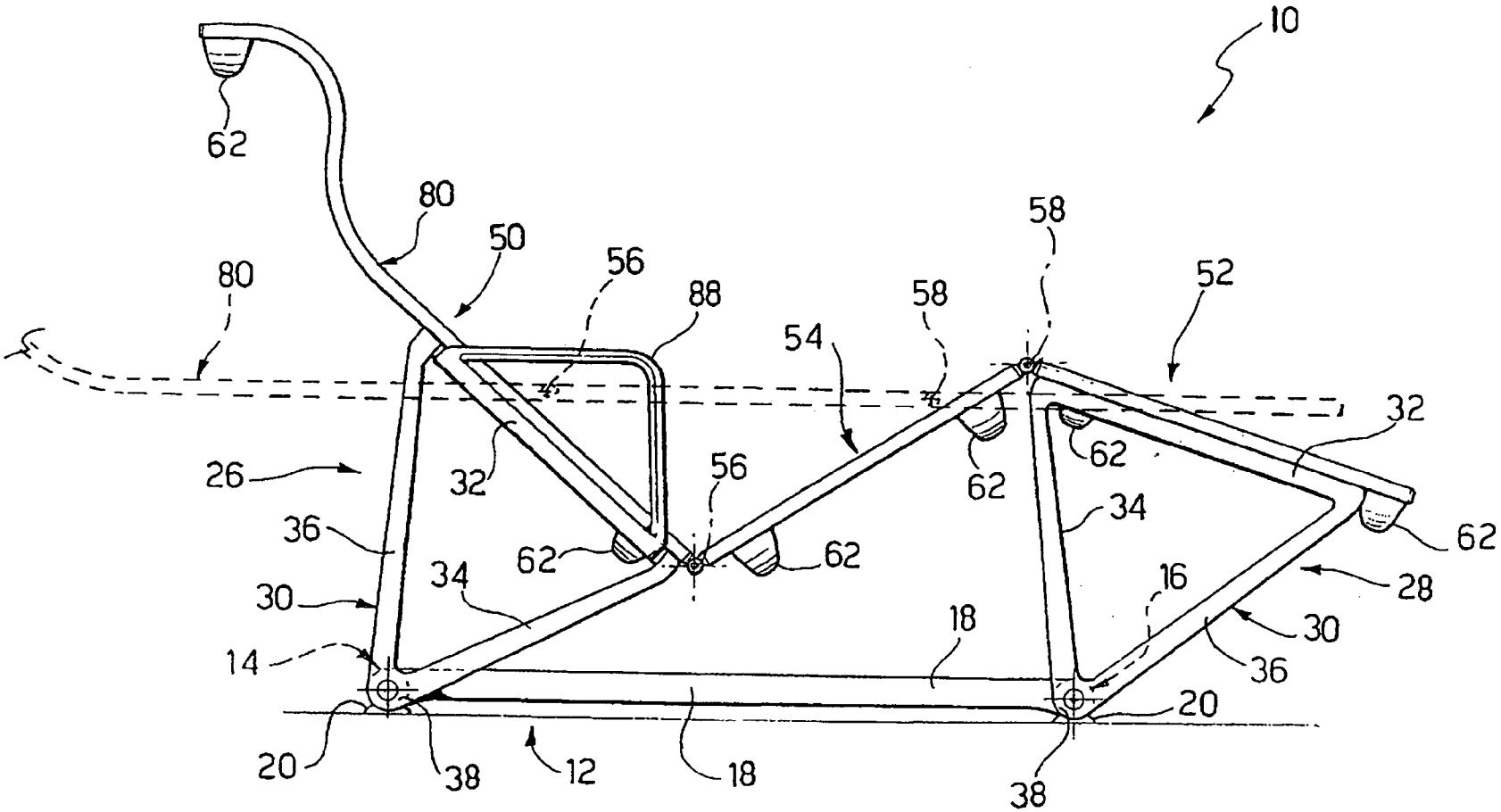
FIGS. 4 and 5 are side views showing the chaise-longue according to the present invention in the two operative positions of FIGS. 1 and 2 respectively.
Figure 5:
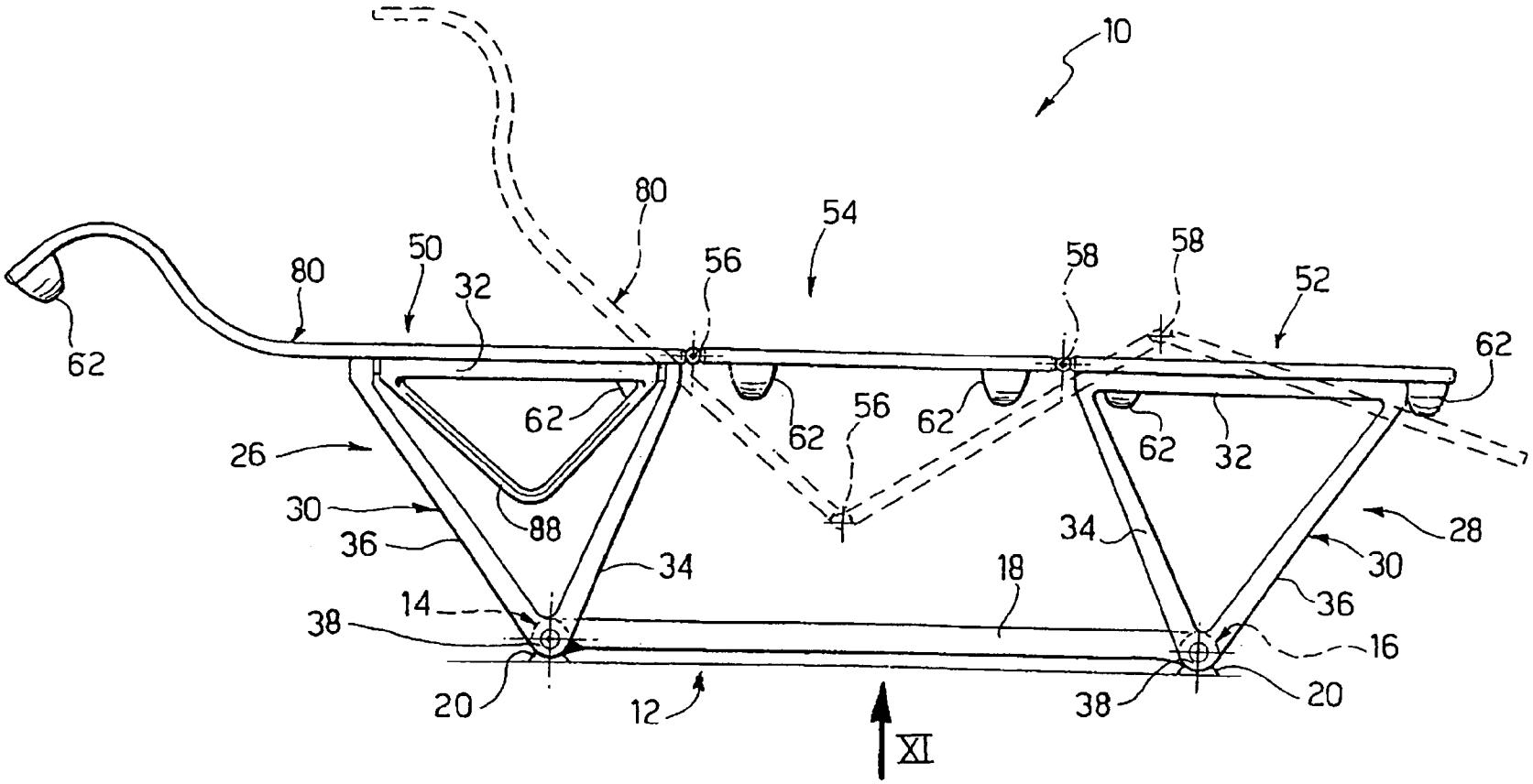
Figure 6:
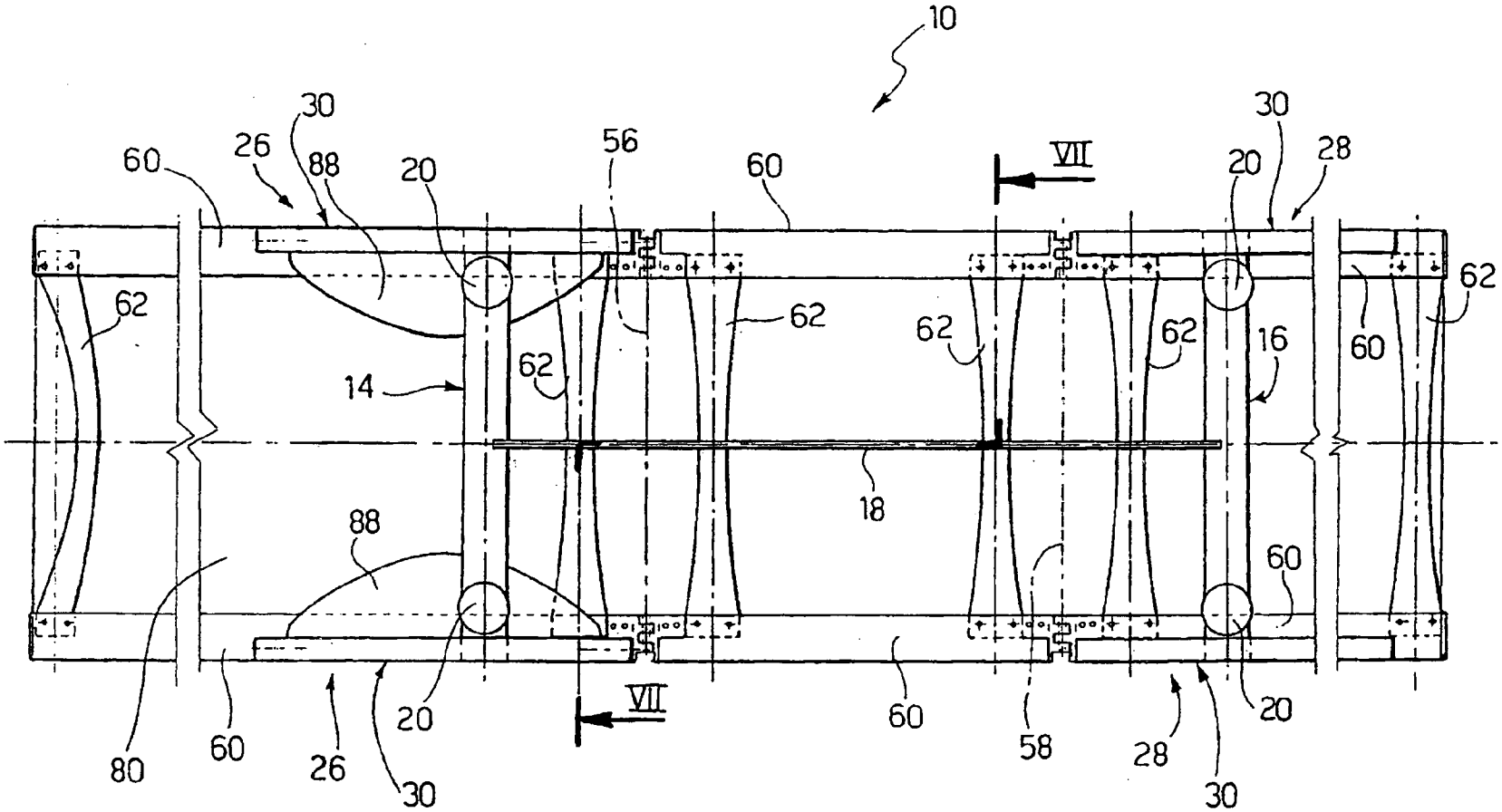
FIG. 6 is a bottom plan view of the chaise-longue according to the invention.

As shown in FIGS. 1 through 5, the chaise-longue 10 can assume a reclining bed position as illustrated in FIGS. 2, 3 and 5 and an armchair position as shown in FIGS. 1 and 4. With reference to FIGS. 2, 3 and 5, the reclining bed position occurs when the upper sides 32 of the triangular support elements 30 are horizontal. In the reclining bed position, the sections 50, 52 and 54 are aligned and substantially coplanar to each other and the fabric 80 forms a substantially horizontal bearing surface.

An armchair position is illustrated in FIGS. 1 and 4 where the backrest section 50 and the footrest section 52 are both inclined in the same direction relative to a horizontal plane while the intermediate section 54 is inclined in the opposite direction. The axis of articulation 56 between the backrest section 50 and the intermediate section 54 is situated lower than the axis of articulation 58 between the intermediate section 54 and the footrest section 52.

FIGS. 4 and 5 show the reclining bed position and the armchair position, respectively. Moreover, in each figure the respective other position of the chaise-longue is illustrated with dashed lines. The two positions shown in FIGS. 4 and 5 are stable positions in which the supports 26, 28 abut against the arresting means of the stationary base 12.

The chaise-longue 10 can include a locking device for locking the chaise-longue 10 in an intermediate position between the two end positions shown in FIGS. 4 and 5. The locking device could be an air spring which the user can lock or unlock, similarly to the air spring that allows the height adjustment of office chairs. The air spring could be positioned in articulated fashion between the movable support 26 and the support base 12 and could be associated to a command organ which the user can operate to lock or unlock the air spring. It is readily apparent that with a locking device of this kind the user is able to lock the chaise-longue in any intermediate position between the extreme end stop positions shown in the drawings.

The present invention may be subject to numerous variations relative to the embodiment shown in the figures. For example, the shape of the movable supports 26, 28 could differ from the illustrations. The shape of the armrests (if present) could also vary relative to the illustrations, and the manner in which the armrests are moved in the inoperative position could vary as well.

A particularly advantageous feature of the present invention consists of the fact that the user can shift from one to the other of the operative positions of the chaise-longue solely by moving his/her weight. The geometry of the triangular support elements 30 is determined in such a way as to facilitate the shifting from one to the other operative positions. In particular, it has been noted that the change in configuration of the chaise-longue is smoother if the outer sides 36 of the triangular support elements 30 have a greater angle of inclination than the inner sides 34 relative to the height of the triangle passing through the vertex 38.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A chaise-longue having a backrest section, a footrest section and an intermediate section, the intermediate section between the backrest section and the footrest section, the chaise-longue comprising:

a base structure having a first transverse member located at a first end and a second transverse member located at an opposite end;

a first movable support arranged to support the backrest section, the first movable support having a triangular shape formed by three elements, wherein the first and second elements are rotationally coupled to the first transverse member of the base structure and the third element is respectively coupled to the first and second elements, the first element having a first end fixedly attached to the backrest section at a first location and the second element having a first end fixedly attached to the backrest section at a second location that is spaced from the first location; and a second movable support arranged to support the footrest section, the second movable support having a triangular shape formed by three elements, wherein the first and second elements are rotationally coupled about the second transverse member of the base structure and the third element is respectively coupled to the first and second elements and fixed directly to the footrest section.

2. The chaise-longue according to claim 1 wherein the first and second movable supports are moveable to a first position where the backrest section, the intermediate section, and the footrest section are arranged in a substantially horizontal bearing plane.

3. The chaise-longue according to claim 1 wherein the first and second movable supports are moveable to a second position where the intermediate section is inclined at a first angle relative to the backrest section and also inclined at a second angle relative to the footrest section.

4. The chaise-longue according to claim 1 wherein the third element of the first moveable support is mechanically fastened to the backrest section.

5. The chaise-longue according to claim 1 wherein the intermediate section is articulatable with respect to the backrest section and with respect to the footrest section.

6. The chaise-longue according to claim 1 wherein the backrest section, the intermediate section and the footrest section each include a pair of lateral longitudinal elements mutually connected by two or more transverse elements.

7. The chaise-longue according to claim 6 wherein the backrest section, the intermediate section and the footrest section, each bear at least a portion of an occupant supporting element, where the respective portion is fastened to respective pairs of the lateral longitudinal elements.

8. The chaise-longue according to claim 7 wherein the occupant supporting element is a monolithic element which extends along the backrest section, the intermediate section and the footrest section.

9. The chaise-longue according to claim 1 further comprising:

an armrest coupled to the first moveable support and movable between an operative position and an inoperative position.

10. The chaise-longue according to claim 9 wherein the armrest is rotationally coupled to an upper side of the third element of the first moveable support.

11. The chaise-longue according to claim 10 wherein the armrest is articulatable about a longitudinal axis and rotatable between an inoperative position and an operative position.

12. The chaise-longue according to claim 1, further comprising:

end stop means for providing two limit end stop positions of the movable supports relative to the base structure.

13. The chaise-longue according to claim 12, further comprising:

a locking device for locking at least one of the movable supports in at least one intermediate position between the end stop positions.

14. A chaise-longue having a first section and a second section, the chaise-longue comprising:

a base member having a first transverse element located at a first end and a second transverse element located at an opposite end; and two movable supports rotationally coupled to the base member, each movable support comprising three elongated elements respectively connected in a triangular shape, a first movable support of the two movable supports having two of the three respective elongated elements rotationally coupled to the first transverse element of the base member and each of the two elements having a first end fixedly attached to the first section at respective first and second locations that are spaced from each other on the first section and the third elongated element fixed to and supporting the first section, a second movable support of the two movable supports having two of the three respective elongated elements rotationally coupled to the second transverse element of the base member, each of the two elements having a first end fixedly attached to the second section at respective first and second locations that are spaced from each other on the second section and the third elongated element fixed to and supporting the second section.

* * * * *